US010689138B2

(12) United States Patent
Laghi

(10) Patent No.: US 10,689,138 B2
(45) Date of Patent: Jun. 23, 2020

(54) SELF-PROPELLED WRAPPING MACHINE AND WRAPPING SYSTEM AND METHOD

(71) Applicant: NOXON S.P.A., Acquaviva Gualdicciolo (SM)

(72) Inventor: Pierangelo Laghi, Ravenna (IT)

(73) Assignee: NOXON S.P.A., Acquaviva Gualdicciolo (SM)

( * ) Notice: Subject to any disclaimer, the term of this patent is extended or adjusted under 35 U.S.C. 154(b) by 207 days.

(21) Appl. No.: 15/750,969

(22) PCT Filed: Aug. 4, 2016

(86) PCT No.: PCT/IB2016/054720

§ 371 (c)(1),
(2) Date: Feb. 7, 2018

(87) PCT Pub. No.: WO2017/025870

PCT Pub. Date: Feb. 16, 2017

(65) Prior Publication Data

US 2019/0002138 A1 Jan. 3, 2019

(30) Foreign Application Priority Data

Aug. 7, 2015 (SM) ..... P-201500193

(51) Int. Cl.
*G06F 7/00* (2006.01)
*B65B 11/02* (2006.01)
(Continued)

(52) U.S. Cl.
CPC ..... *B65B 11/025* (2013.01); *B65B 41/16* (2013.01); *B65B 57/16* (2013.01)

(58) Field of Classification Search
None
See application file for complete search history.

(56) References Cited

U.S. PATENT DOCUMENTS 4,067,174 A 1/1978 Goldstein
4,095,395 A 6/1978 Goldstein
(Continued)

FOREIGN PATENT DOCUMENTS

EP 0 143 404 6/1985
FR 2 391 111 12/1978
(Continued)

OTHER PUBLICATIONS

International Search Report (ISR) dated Dec. 2, 2016 in International (PCT) Application No. PCT/IB2016/054720.

*Primary Examiner* — Yolanda R Cumbess
(74) *Attorney, Agent, or Firm* — Wenderoth, Lind & Ponack, L.L.P.

(57) ABSTRACT

A self-propelled wrapping machine movable around a load, for wrapping the latter with a film of plastic material, comprises a self-propelled carriage with guide means, a column fixed to the carriage and slidably supporting an unwinding unit of the film, sensor means to detect surfaces and/or external edges of the load in their total extension and along a detection direction and process related signals, a control unit to receive the signals from the sensor means, calculate a peripheral outline of plan maximum overall dimension of the load on the basis of the surfaces and/or external edges detected by the sensor means, and process a wrapping path of the wrapping machine around the load on the basis of the peripheral outline so as to avoid collisions with the load; the control unit controls the guide means to guide the wrapping machine along the wrapping path.

20 Claims, 5 Drawing Sheets

(51) Int. Cl.
*B65B 57/16* (2006.01)
*B65B 41/16* (2006.01)

(56) References Cited

U.S. PATENT DOCUMENTS

| | | | | |
|---|---|---|---|---|
| 4,631,898 | A | 12/1986 | Brarnbilla | |
| 5,655,356 | A * | 8/1997 | Ginestra | B65B 59/00 53/168 |
| 5,671,593 | A * | 9/1997 | Ginestra | B65B 59/00 53/168 |
| 2007/0169442 | A1 | 7/2007 | Asioli | |
| 2019/0263603 | A1* | 8/2019 | Saylor | B65B 5/08 |

FOREIGN PATENT DOCUMENTS

| | | |
|---|---|---|
| GB | 2487935 | 8/2012 |
| WO | 2005/110852 | 11/2005 |
| WO | 2012/153248 | 11/2012 |
| WO | 2013/050832 | 4/2013 |

* cited by examiner

SELF-PROPELLED WRAPPING MACHINE AND WRAPPING SYSTEM AND METHOD

The invention relates to mobile or self-propelled wrapping machines that are arranged for wrapping a film made of stretchable plastic material around a load consisting of a product or a plurality of products that are arranged on a bench or a pallet. The invention also relates to a system and a method for wrapping loads with a self-propelled wrapping machine.

The self-propelled wrapping machines, also called self-propelled wrapping robots, are machines that are generally used for wrapping loads with variable dimensions and forms and in productions of limited entity, typically in environments or rooms wherein the fixed or static wrapping machines cannot be used due to the overall dimensions and/or the available space. The loads are generally formed by pallets on which a plurality of products and/or objects, also with different dimensions and forms, are arranged and more or less regularly superimposed.

In other cases the wrapping, normally for protective purposes, directly relates to the product, which is generally with large dimensions.

The self-propelled wrapping machines typically include a cart or carriage that is provided with motorized traction rear-wheels and with a front guide device that comprises one or more steering wheels, which are handled by a steering. The steering is drivable by means of a guide bar by an operator for manually leading the machine in a maneuvering configuration, or by a feeler element that is able to follow the profile or the external outline of the load in an operating working configuration, wherein the self-propelled machine rotates in an independent and automatic manner around the load for wrapping the latter with the film.

The feeler element comprises, particularly, an arm that externally and laterally extends with respect to the carriage and is provided at its end with a feeler idler wheel that is able to follow the profile or external outline of the load to be wrapped. The feeler element exerts on the load a predefined elastic compression or thrust force, so as to maintain the contact with said load and enable the machine to move in a reliable manner around the latter along a trajectory that is determined by the outline itself of the load.

The carriage supports a vertical column along which an unwinding or supplying unit, which houses a reel of plastic film and is provided with a plurality of rollers for unwinding and pre-stretching the film, is movable with an alternate rectilinear motion. More precisely, the unwinding unit is generally provided with a pair of pre-stretching rollers that are arranged for unwinding the film from the reel and pre-stretching or elongating the film by a predefined percentage, and one or more return rollers for deflecting the film toward the load.

The combination of the alternate linear motion of the unwinding apparatus along the vertical pillar and of the rotation of the self-propelled machine around the load enables to wrap the film around the latter so as to form a series of braided strips or bands. The plastic film is wrapped so as to completely wrap all the sides of the load.

A drawback of the known self-propelled wrapping machines that are provided with a feeler element consists in the fact that if the load has an irregular profile or outline, for example because the load is provided with indentations or recesses, the feeler element can be blocked determining the stop of the wrapping machine. Furthermore, the feeler element of the known wrapping machines permits to follow the external outline of the load to be wrapped only at a lower base portion of the latter (typically at the pallet) not being in fact able to detect the outline at different heights along the vertical development of the load itself.

In case of loads that are composed by a plurality of products and/or objects that are more or less regularly stacked and superimposed on a pallet, the feeler element indeed is not able to detect protruding objects that are arranged at a certain height on the pallet, thus determining collisions with the vertical pillar and/or with the film unwinding unit and therefore the interruption of the wrapping process.

Another drawback of the known self-propelled wrapping machines that are provided with a feeler element consists in the fact that they are not able to wrap loads that are composed by products with reduced weight and/or fragile and/or not arranged on pallets, since the elastic thrust force that is exerted by the feeler wheel of the feeler element can cause the displacement of the products or their damage.

The wrapping process in the known self-propelled wrapping machines provides the identification of the load to be wrapped, for example between a plurality of loads that are present in a working area, and therefore that an operator manual approaches and positions the wrapping machine at the selected load. Such procedure for the identification of the load to be wrapped and the subsequent displacing and positioning of the wrapping machine, however, require long time, i.e. an increase of the duration of the wrapping cycle of the load.

The operator, when the machine is moved close to the load and the feeler element is positioned in contact with the latter, has then to set the wrapping parameters on the control panel of the machine, among which the height of the load (total height and eventually thickness of the pallet, if present). These measures are necessary for calculating the operating stroke of the unwinding unit along the vertical pillar during the wrapping process.

However, the measure of the height of the load is not always easily available to the operator, especially in case of loads that are composed by a plurality of superimposed various objects with shapes and dimensions that are different from each other. In these cases, the operator has to proceed with a manual measurement of such height, thus determining an increase of the wrapping times. Alternatively, the operator can estimate by eye such height, with the risk, however, that the wrapping is not correctly performed.

One object of the invention is to improve the known self-propelled wrapping machines that are arranged for wrapping a load with a film made of stretchable plastic material.

Another object is to provide a self-propelled wrapping machine which enables to wrap in a complete and reliable manner loads having irregular profiles or shapes, for example provided with recesses and/or protrusions, such as loads that are composed by protruding and overflowing products.

A further object is to provide a self-propelled wrapping machine that enables to wrap in a safe and reliable manner loads that are composed by products with reduced weight and/or fragile and/or that are not arranged on supporting pallets.

Another further object is to provide a system and a method for wrapping with plastic film a plurality of loads that are present in a working area, using one or more self-propelled wrapping machines, in a substantially automated manner, minimizing the manual intervention of an operator.

A still further object is to provide a system and a method for wrapping loads that are present in a working area that enable to minimize the duration of wrapping cycles, particularly reducing the pre-disposition and regulation times of the self-propelled wrapping machine at the load to be wrapped.

In a first aspect of the invention a self-propelled wrapping machine according to claim 1 is provided.

In a second aspect of the invention a method for wrapping a load with a plastic film according to claim 8 is provided.

In a third aspect of the invention a system for wrapping loads with a film made of plastic material according to claim 13 is provided.

In a fourth aspect of the invention a method for wrapping loads with a film made of plastic material according to claim 19 is provided.

In a fifth aspect of the invention a self-propelled wrapping machine according to claim 23 is provided.

In a sixth aspect of the invention a method for wrapping a load with a film made of plastic material according to claim 25 is provided.

The invention can be better understood and implemented with reference to the attached drawings that illustrate some exemplifying and not limitative embodiments thereof, wherein.

Figure 1:
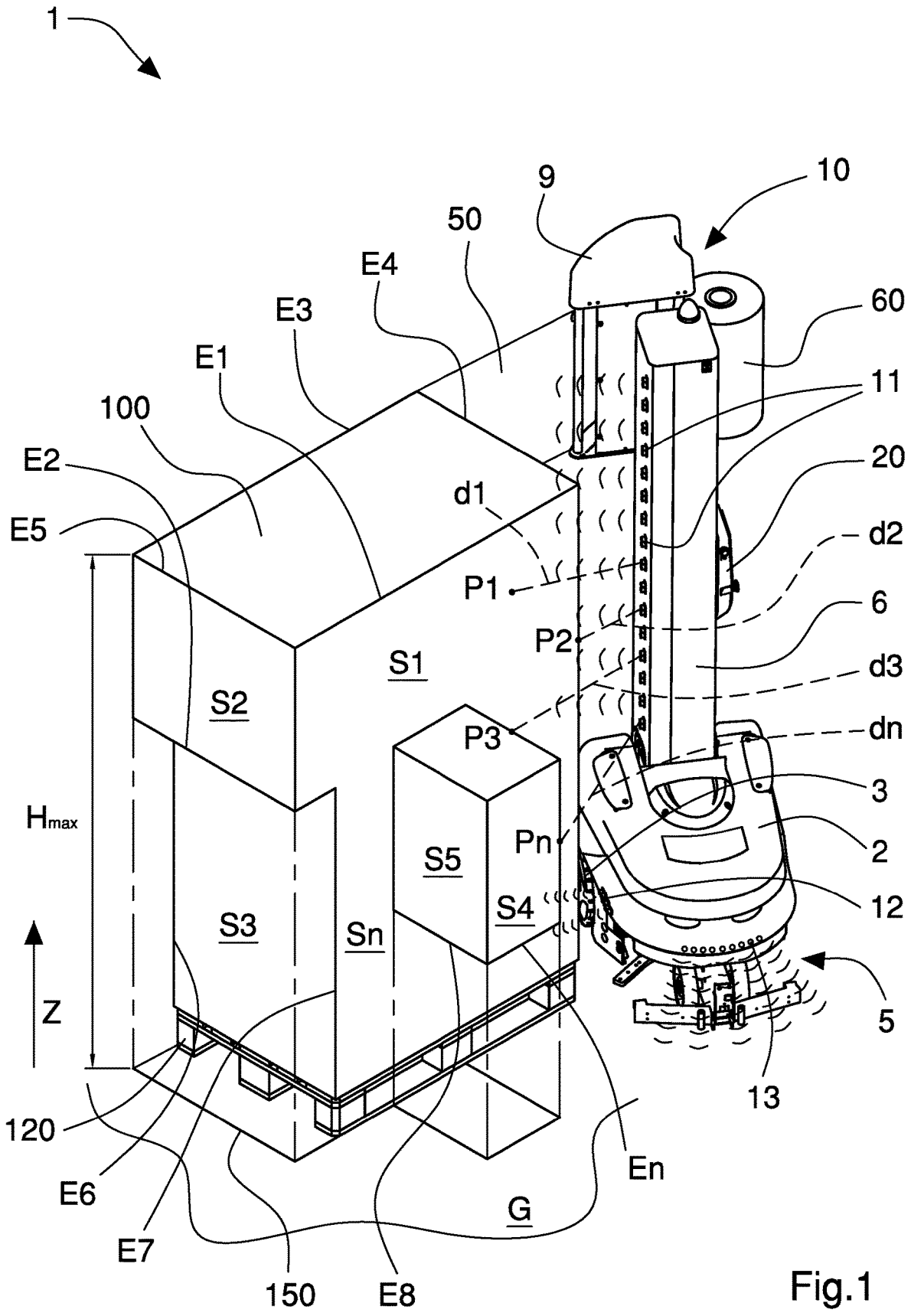
FIG. 1 is a perspective view of the self-propelled wrapping machine of the invention associated with a load to be wrapped and in an operating wrapping phase.
Figure 2:
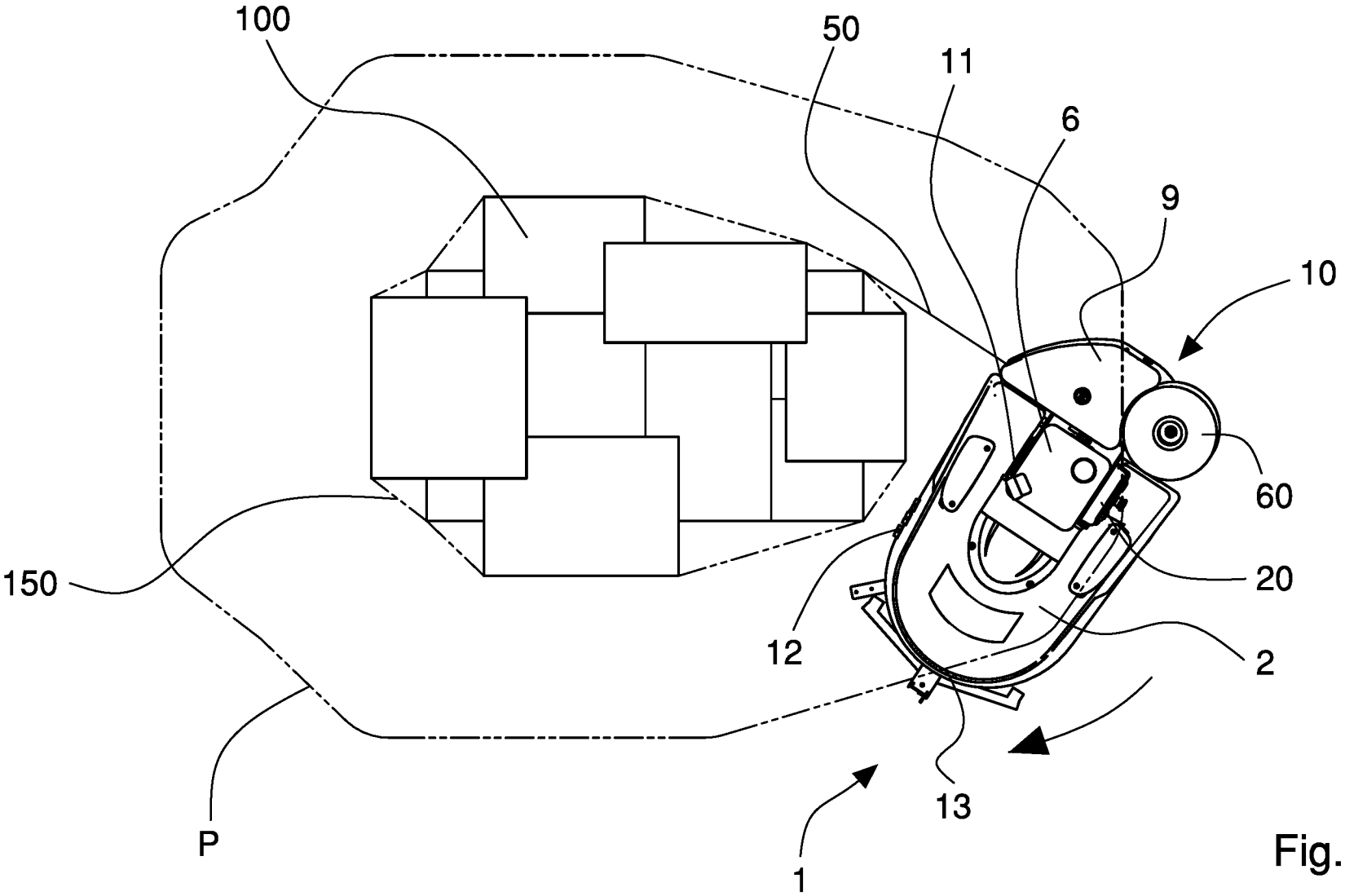
FIG. 2 is a plan view of the wrapping machine and of the load of FIG. 1 that highlights a peripheral outline of plan maximum overall dimensions of said load and a wrapping path of the wrapping machine around said load.

With reference to FIGS. 1 and 2 the self-propelled wrapping machine 1 according to the invention is illustrated, which is movable around a load 100 for wrapping the latter with a film 50 made of plastic material, in particular of the cold-stretchable type.

The wrapping machine comprises a self-propelled carriage 2 that is provided with traction wheels 3, at least one directional wheel 4, guide means 5 for routing or driving the carriage 2, and a pillar or column 6, for example vertical, that is fixed to the carriage 2 and slidably supports an unwinding unit 10 of said film 50. In the example that is illustrated in the figures, the carriage 2 is provided with a pair of traction rear-wheels 3, which are driven by a motor, and a pair of directional front-wheels 4, which are moved by the guide means 5 so as to steer together and route the carriage 2.

Alternatively, the directional wheel can be a pivoting wheel and the guide means 5 can comprise driving means that is able to vary the speed of the traction wheels, such speed variation enabling the carriage 2 to steer.

The unwinding unit 10, of known type and not illustrated in detail in the figures, comprises frame means 9 for supporting a reel 60 of film 50 and roller means for unwinding, pre-stretching and deflecting towards the load 100 the film 50. Particularly, the roller means comprises a first pre-stretching roller and a second pre-stretching roller that are rotated around respective longitudinal axes with different rotation speeds so as to stretch or elongate the plastic film 50 while the reel 60 is unwound and before the load 100 is wrapped.

The self-propelled wrapping machine 1 comprises sensor means 11, 12, 13 that is arranged for totally and entirely detecting surfaces S1, S2, S3, . . . Sn and/or external edges E1, E2, E3, . . . En of the load 100, particularly in their total extension along a detection direction Z nearly orthogonal to a support plane G of the load 100 itself, and then processing related signals (in FIG. 1 only some of the surfaces and the external edges of the load 100 are indicated with the numerical references, as an example). The wrapping machine 1 also includes a control unit 20 that is arranged for receiving from the sensor means 11, 12, 13 the above-mentioned signals and calculating a profile or a peripheral outline 150 of plan maximum overall dimensions of said load 100 on the basis of the detected surfaces S1, S2, S3, . . . Sn and/or the external edges E1, E2, E3, . . . En. In other words, as better explained in the following description, the control unit 20, by processing the data that are related to all the surfaces S1, S2, S3, . . . Sn and/or external edges E1, E2, E3, . . . En of the load 100 in a complete way, along the whole perimeter of the latter and for its whole height, is able to calculate a maximum overall dimensions (the peripheral outline 150) of the latter on the supporting plane G (typically a plane of the working area W on which the load 100 and the wrapping machine 1 are positioned). The maximum overall dimensions or peripheral outline 150 is substantially obtained by projecting along a vertical direction that is orthogonal to the supporting plane G, the different overall dimensions (shapes and/or dimensions) of the load 100 along the whole development in height of the latter, i.e. by interpolating with a curve or broken line the most projecting points or portions of the load 100 along its perimeter and considering its whole vertical development. The maximum peripheral outline 150 can be also obtained by interpolating or superimposing the different peripheral outlines of a plurality of cross-sections of the load, which are parallel to each other and to the supporting plane G (FIG. 2). In this manner, within the peripheral outline 150 there are contained not only the pallet 120 of the load 100 but also all the products that compose the latter, and particularly the products outwardly protruding from the load 100.

On the basis of the so-calculated peripheral outline 150, the control unit 20 is also able to calculate a wrapping path P of the wrapping machine 1 around the load 100 itself so as to avoid collisions of said wrapping machine 1 with the latter, in particular collisions with the body 2 or the vertical column 6 or the unwinding unit 10. The wrapping path P is a loop-closed curve.

The control unit 20 also controls the guide means 5 in order to guide the wrapping machine 1 along said wrapping path P.

On the basis of the surfaces and/or the external edges of the load 100 that are detected by the sensor means 11, 12, 13, the control unit 20 is able to calculate also a maximum height $H_{max}$ of the load 100 with respect to the supporting plane G.

The control unit 20 is provided with suitable processing and calculating means and data storage means for saving, with reference to the load 100 to be wrapped, data related to the surfaces S1, S2, S3, . . . Sn and/or external edges E1, E2, E3, . . . En that are detected by the sensor means 11, 12, 13, to the peripheral outline 150 of the so-calculated plan maximum overall dimensions and to the corresponding optimal wrapping path P.

The control unit 20 and the sensor means are connected to each other by means of a data communication network, via cable or in a so-called wireless mode.

In the illustrated embodiment, the guide means 5, of known type and not illustrated in detail in the figures, comprises first actuating means, for example of electrical type, which is controlled by the control unit 20 and arranged for steering or orienting the directional wheels 4 during the operation of the wrapping machine 1.

Alternatively or additionally, the guide means 5 can comprise driving means, which is controlled by the control unit 20, for varying the speeds of the two traction wheels 3 in an independent and distinct way.

Second actuating means is provided for moving the unwinding unit 10 along the column 6 with alternate movement so as to wrap the load 100, around which the self-propelled wrapping machine 1 moves along the loop-closed wrapping path P, with a series of braided bands or strips of film 50. The control unit 20 controls the second actuating means for moving the unwinding unit 10 as a function of the calculated maximum height $H_{max}$. More precisely, the control unit 20, when said maximum height $H_{max}$ and a minimum height from the supporting surface G (for example equal to a thickness of the pallet 120 of the load 100) are known, calculates the operating stroke of the unwinding unit 10, and in particular a lower position and an upper position that are assumed by the latter along the column 6.

The sensor means 11, 12, 13, 21 is also able to detect, in addition to the surfaces and/or edges of the load 100, eventual obstacles that are arranged along the wrapping path P and send a related signal to the control unit 20 for stopping the operation and movement of the wrapping machine 1.

In the embodiment illustrated in FIGS. 1 and 2, the sensor means comprises a plurality of sensors 11, 12, 13, particularly ultrasonic sensors or ToF (Time of Flight) optical sensors, that are arranged on the body 2 and on the column 6.

The ultrasonic or ToF optical sensors 11, 12, 13, of known type and not described in detail, are able to measure a plurality of distances d1, d2, . . . dn of the wrapping machine 1 (namely of the sensors themselves) from a corresponding plurality of points P1, P2, . . . Pn of said surfaces S1, S2, . . . Sn and/or of said external edges E1, E2, . . . En of the load 100 (in FIG. 1 only some of the points P1, P2, . . . Pn of the surfaces and the external edges of the load are indicated with the numerical references, as an example). The control unit 20 processes these distances d1, d2, . . . dn that are measured by the sensors for recreating the surfaces S1, S2, . . . Sn and/or the external edges E1, E2, . . . En (for instance by processing a tridimensional model) in a complete way and in their total extension, and then calculating the peripheral outline 150 of plan maximum overall dimensions of the load 100 on the basis of these surfaces and external edges. The control unit 20 particularly identifies and saves the surfaces S2, S4 and/or the external edges E2, E3, E6-E10 that are most protruding along the whole external perimeter of the load 100 and for the whole height of the latter so as to "reconstruct" by interpolation, the peripheral outline 150 of plan maximum overall dimensions.

Alternatively, the control unit 20 can use the so-called SLAM (Simultaneous Localization And Mapping) calculation method to tridimensionally scan or "map" the load 100 so as to extrapolate its peripheral outline 150 of plan maximum overall dimensions.

As illustrated in the embodiment of FIG. 1, the sensor means comprises first ultrasonic sensors 11 that can be regularly arranged and mutually spaced apart along the column 6 so as to detect in a complete way and in their total extension the surfaces S1, S2, . . . Sn and/or the external edges E1, E2, . . . En of the load 100 along the whole height of the latter and progressively during the movement of the wrapping machine 1 around the load 100 itself, as better explained in the following description.

The sensor means comprises also second ultrasonic sensors 12 that are positioned on the body 2 on a front and lateral portion of the latter, oriented in the direction of the load 100 so as to detect distances from the latter at a height that is close to the height of the pallet 120. The second ultrasonic sensors 12 substantially verify that during the operation the front part of the wrapping machine 1 does not get too close to, or even does not collide with, the load 100, in the event that the proceeding of the wrapping machine does not exactly follow the calculated wrapping path P for unforeseen reasons.

The sensor means further comprises third ultrasonic sensors 13 that are also positioned on the body 2 on a front forward portion for cooperating with the second ultrasonic sensors 12 in the control of the distance with respect to the load 100 and particularly for detecting eventual obstacles, for example people or objects, that places themselves on the wrapping path P and thus enable the emergency stop of the wrapping machine 1 in order to avoid dangerous impacts and shocks.

In a variant of the wrapping machine 1 not illustrated in the figures, the sensor means comprises a plurality of ToF optical sensors that are disposed along the column 6 and/or the body 2. Each ToF optical sensor, of known type, is provided with a laser emitter that is able to transmit pulsed light and with a mirror system that is able to transform said pulsed light in a 'cloud of points' P1, P2, . . . Pn hitting the surfaces and the external edges of the load. The reflected rays are detected by one or more receivers of said optical sensor. The rotation angles of the mirrors, combined with the measure of the phase shift of the reflected rays, gives the distance for each point P1, P2, . . . Pn. This way, the sensor can recreate the surface hit by the cloud of points.

The self-propelled wrapping machine 1 of the invention is also provided with a position or location tracking device, which enables to detect the position in the space of the wrapping machine 1. The control unit 20 is arranged for using the data that are provided by the tracking device for controlling the displacement of the wrapping machine along the wrapping path P.

The operation of the wrapping machine 1 of the invention and the related wrapping method provide an approaching phase wherein the self-propelled wrapping machine 1 is positioned, for example manually by an operator, at a load 100 to be wrapped.

A detecting phase is therefore provided, wherein the machine 1, and in particular the sensor means 11, 12, 13, is activated for detecting a surface S1, S2, . . . Sn and/or an external edge E1, E2, . . . En of the load 100 that is closest to the wrapping machine 1 itself, in particular to the body 2 and/or column 6.

In this detecting phase, the wrapping machine 1 is then moved around the load 100, preferably with a reduced speed that is lesser than an operating speed during a next wrapping phase and preferably for at least one starting round, so as to maintain a predefined minimum distance, which is detected by the sensor means 11, 12, 13, from the load 100. More precisely, the control unit 20 controls the guide means 5 so as to maintain the sensors 11, 12, 13 at said predefined minimum distance, by approaching the machine 1 to the load 100, if the distance increases, or by moving the machine away from the load, if the distance decreases.

At the same time, while the wrapping machine rotates about the load 100, the first sensors 11 that are distributed along the column 6 and/or on the body 2 detect and save, in their total extension, surfaces S1, S2, . . . Sn and/or external edges E1, E2, . . . En of the load 100 along the whole height of the latter, so that each protruding portion of the load can be detected.

More specifically, during the movement around the load 100, during at least one starting round, the data related to the surfaces S1, S2, . . . Sn and/or to the external edges E1, E2, . . . En of the load 100 which are detected by the sensors 11, 12, 13, are saved by the control unit 20 that calculates the peripheral outline 150 of plan maximum overall dimensions of the load 100 on the basis of said surfaces S1, S2, . . . Sn and/or external edges E1, E2, . . . En. More specifically, through the sensors 11, 12, 13 which measure the distances by the points of the surfaces and the edges, the control unit 20 reconstructs the different peripheral outlines of the load 100 along the whole vertical development (cross-sections parallel to the supporting plane G) of the latter i.e. it detects and maps the most protruding points or portions of the load 100 along its perimeter and considering the whole vertical development of the latter. From this peripheral outlines, the control unit 20 can obtain by interpolation, or by superimposition, the peripheral outline 150 of plan maximum extension (FIG. 2).

On the basis of the said peripheral outline 150, the control unit 20 then calculates the wrapping path P of the wrapping machine 1 around the load 100, which enables to avoid collisions with the latter.

In the rounds coming after the starting one, the wrapping machine 1 moves following the calculated wrapping path P.

When the detecting phase and the starting round end, the machine is stopped and the operator fixes an initial flap of the film 50 coming from the unwinding unit 10 to the load 100. The unwinding unit is placed along the column 6 at a minimum height from the support plane G (for example equal to the width or height of the pallet 120 supporting the load 100).

The wrapping machine 1 is then activated in a wrapping phase and starts to move around the load 100 with the set operating speed, following the previously calculated wrapping path P, wrapping the load 100 with the film 50, that is beforehand stretched or elongated if required.

Alternatively, the operation of the wrapping machine 1 of the invention and the corresponding wrapping method can provide that the operator fixes the initial flap of the film 50 to the load 100 before the wrapping machine 1 is activated.

In this way, even during the detecting phase, the film 50 is supplied by the unwinding unit 10 and wrapped around the load 100.

At the end of the detecting phase, after the starting round about the load 100 with reduced speed, the wrapping phase starts wherein the wrapping machine 1 is moved along the wrapping path P with the set wrapping operating speed so as to wrap the entire load 100 with the film 50.

While operating, the control unit 20, on the basis of the surfaces S1, S2, . . . Sn and/or external edges E1, E2, . . . En that are detected by the sensors 11, 12, 13, is able to determine a maximum height $H_{max}$ of the load 100 with respect to a supporting plane G, and then calculate the operating stroke of the unwinding unit 10, in particular a lower position and an upper position that are assumed by the latter along the column 6. During the wrapping phase, the control unit 20 controls the second actuating means so as to move the unwinding unit 10 along the column 6 with alternate movement for wrapping the load 100, around which the self-propelled wrapping machine 1 moves, with a series of braided strips or bands of film 50.

It should be noted that, if during the operation of the wrapping machine 1 an obstacle, for example an operator or an object, places itself on the wrapping path P or passes through the latter when the wrapping machine 1 is arriving, the sensors 11, 12, 13 are able to detect in real-time its presence and enable an immediate and emergency stop of the wrapping machine 1 in order to avoid dangerous impacts and shocks.

Thanks to the self-propelled wrapping machine 1 of the invention and to the related wrapping method is thus possible to wrap in an effective and efficient manner a load, for example constituted by a plurality of products that are arranged on a pallet, without the need to touch the load by means of a feeler element. The sensor means, which the wrapping machine of the invention is provided with, enables, in fact, to detect surfaces S1, S2, . . . Sn and/or external edges E1, E2, . . . En of the load 100 in their total extension and along the detection direction Z on the basis of which the control unit 20 is able to calculate a peripheral outline 150 of plan maximum overall dimensions of said load 100, and then process a wrapping path P of the wrapping machine 1 around the load 100 so as to avoid collisions with the latter.

Since the peripheral outline 150 represents in plan, on the supporting plane G, the maximum overall dimensions of the load 100 in its vertical extension too (not only the pallet 120 supporting the load 100, but also all the products which compose the latter, and in particular the products protruding outward, are contained within the peripheral outline 150), the self-propelled wrapping machine 1 of the invention is able to wrap in a complete and reliable manner loads having irregular profiles or shapes, for example provided with recesses or protrusions, which are variable in height, such as loads composed by protruding and overflowing objects, without the risk of collisions with the body 2 or with the column 6.

Furthermore, as the feeler element lacks, the self-propelled wrapping machine of the invention, in addition to getting not blocked in eventual indentations or recesses that are present on the load, permits to wrap in a secure and reliable manner loads that are composed by products with reduced weight and/or fragile and/or that are not arranged on supporting pallets since no contact is provided, the interaction with the wrapping machine being limited to the film 50 that is progressively wrapped.

Thanks to the self-propelled wrapping machine 1 of the invention it is also possible to wrap in a substantially automatic manner loads with different heights without the need for manual measurements by an operator, since the control unit 20 is able to calculate, from the data that are detected by sensor means 11, 12, 13, a maximum height $H_{max}$ of the load 100 itself.

A variant of the self-propelled wrapping machine 1 of the invention is provided, that is different from the previously described embodiment in that the control unit 20 is arranged to receive from the sensor means 11, 12, 13, 21 the signals related to the surfaces S1, S2, . . . Sn and/or the external edges E1, E2, . . . En of said load 100 that are detected in their total extension and along the detection direction Z during the rotation of the wrapping machine 1 about the load 100, and then guide the wrapping machine 1 around the load 100 itself so as to avoid collisions with the above-mentioned detected surfaces S1, S2, . . . Sn and/or external edges E1, E2, . . . En. Also in this case, the sensor means comprises a plurality of sensors 11, 12, 13, particularly ultrasonic sensors or ToF optical sensors, placed on the body 2 and/or on the column 6 and apt to measure a plurality of distances d1, d2, . . . dn of the wrapping machine 1 from a corresponding plurality of points P1, P2, . . . Pn of the surfaces S1, S2, . . . Sn and/or of the external edges E1, E2, . . . En of the load 100. The control unit 20 is able to recreate the surfaces S1, S2, . . . Sn and the external edges E1, E2, . . . En in their total extension on the basis of the distances d1, d2, . . . dn that are measured and then control the guide means 5 to guide the wrapping machine 1 around the load 100 so as to avoid collisions with the surfaces S1, S2, . . . Sn and/or the external edges E1, E2, . . . En.

The working of this variant of the wrapping machine 1 and the corresponding wrapping method provide positioning the wrapping machine 1 at the load 100 to be wrapped and activating the sensors 11, 12, 13 to detect one surface S1, S2, . . . Sn and/or one external edge E1, E2, . . . En of the load 100 closest to the wrapping machine 1.

An operator then fixes an initial flap of the film 50 coming from the unwinding unit 10 to the load 100. The unwinding unit is placed along the column 6 at a minimum height from the support plane G (for example equal to the width or height of the pallet 120 supporting the load 100).

The wrapping machine 1 is then activated and moved around the load 100, wrapping it with the film 50 and detecting the surfaces S1, S2, . . . Sn and/or the external edges E1, E2, . . . En of the load 100 in their total extension.

During the movement, the guide means 5 of the wrapping machine 1 are controlled so as to guide the latter around the load 100 avoiding collisions with the surfaces S1, S2, . . . Sn and/or the external edges E1, E2, . . . En for a plurality of rounds for wrapping the film around the load.

Detecting the surfaces S1, S2, . . . Sn and/or the external edges E1, E2, . . . En of the load 100 in their total extension particularly comprises measuring a plurality of distances d1, d2, . . . dn of the wrapping machine 1 from a corresponding plurality of points P1, P2, . . . Pn of the surfaces S1, S2, . . . Sn and/or of the external edges E1, E2, . . . En and recreating the above-mentioned surfaces S1, S2, Sn and external edges E1, E2, . . . En on the basis of the distances d1, d2, . . . dn measured by the sensors 11, 12, 13.

Figure 3:
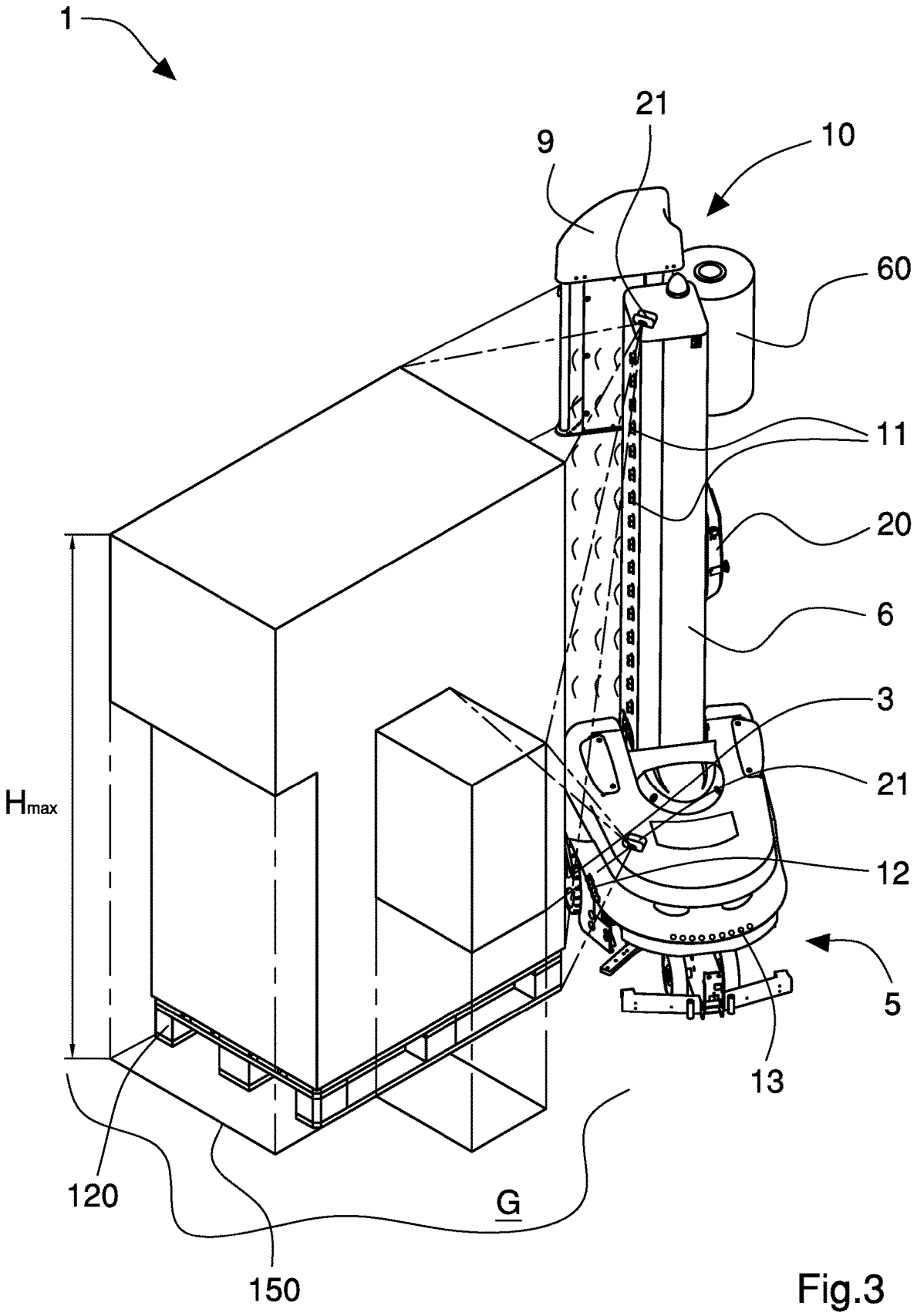
FIG. 3 is a perspective view of a variant of the self-propelled wrapping machine of the invention associated with the load and in an operating wrapping phase.

FIG. 3 illustrates a variant of the self-propelled wrapping machine 1 of the invention which differs from the embodiment that is previously described and illustrated in FIGS. 1 and 2, for the fact that the sensor means, in addition to the ultrasonic or ToF optical sensors 11, 12, 13, comprises one or more imaging optical sensors 21, in particular two, that are fixed, for example, on a front portion of the body 2 and on the top of the column 6. The two imaging optical sensors 21 are able to capture images of the surfaces and/or the external edges of the load 100. These images are processed and handled by the control unit 20 so as to obtain data related to said surfaces and/or edges with which the peripheral outline 150 of plan maximum overall dimensions of the load 100 and then the wrapping path P is calculated.

The imaging optical sensors 21 can comprise, for example, digital cameras or digital video cameras or laser scanner sensors that are able to capture two-dimensional or three-dimensional images of the load 100, from which surfaces, edges, overall dimensions and size of the latter in the space are obtained.

In a not illustrated variant of the wrapping machine 1 of the invention, the imaging optical sensors comprise two "intelligent" video cameras, so-called "smart camera" of known type, apt to capture digital images of the load 100 and provided with integrated processors that are able to process the captured images and extract data that are related to lines, borders, edges of a three-dimensional profile of said load 100 for creating a more or less detailed three-dimensional model of the latter. On the basis of the three-dimensional model of the load 100 that is processed by the intelligent camera or by the control unit 20, the latter is able to calculate the peripheral outline 150 of plan maximum overall dimensions of the load itself.

The operation of this variant of the self-propelled wrapping machine 1 is substantially similar to the one previously described for the embodiment of FIGS. 1 and 2, differing only in that the detection of the surfaces and/or external edges of the load 100 is performed by imaging optical sensors 21 in cooperation with the sensors 11, 12, 13 so as to obtain more precise data that the control unit 20 can process for calculating the peripheral outline 150 of plan maximum overall dimensions.

In a variant of the self-propelled wrapping machine 1 of the invention it is provided that the sensor means comprises only the imaging optical sensors 21 for detecting surfaces and/or external edges of the load 100 and any obstacles that are arranged along the wrapping path P.

Figure 4:
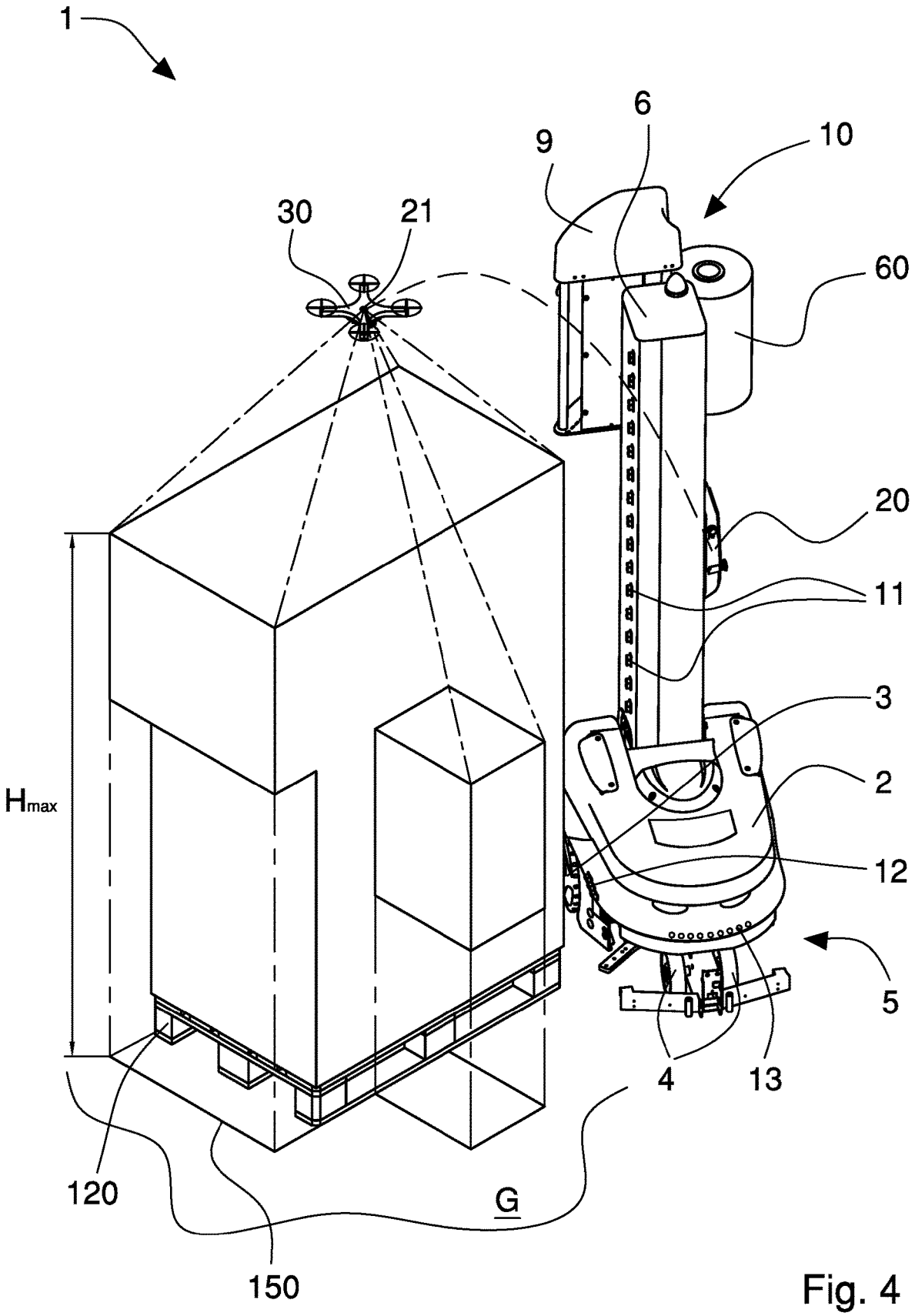
FIG. 4 is a perspective view of another variant of the self-propelled wrapping machine of the invention associated with the load.

With reference to FIG. 4 a further variant of the self-propelled wrapping machine of the invention is illustrated that differs from the variant that is described above and illustrated in FIG. 3 in that the imaging optical sensor 21, for example a camera or a video camera or a laser scanner sensor, is mounted on a drone 30, i.e. a small flying vehicle that is remote-controlled and remotely movable by an operator. The imaging optical sensor 21 is connected, by wireless transmission means of known type, to the control unit 20, which is provided with receiving means.

In this case, the imaging optical sensor 21 is able to detect from the top an image of the load 100 by means of which it is easy for the control unit 20 of the wrapping machine 1, through the elaboration of the outlines and edges, to calculate the peripheral outline 150 of maximum overall dimensions of the load 100, and then the wrapping path P.

It is not therefore necessary to detect the surfaces and/or external edges of the load 100 by moving for at least one round the wrapping machine 1 around the latter, the detecting phase requiring only the passage of the drone 30 over the load 100, being the wrapping machine 1 also positioned at a distance.

The wrapping machine 1 can be provided with the ultrasonic or ToF optical sensors 11, 12, 13 for verifying that, during the wrapping phase, the wrapping machine 1 does not get too close to, or even does not collide with, the load 100, in the case that the displacement of the wrapping machine 1 does not exactly take place along the calculated wrapping path P for unforeseen reasons.

Figure 5:
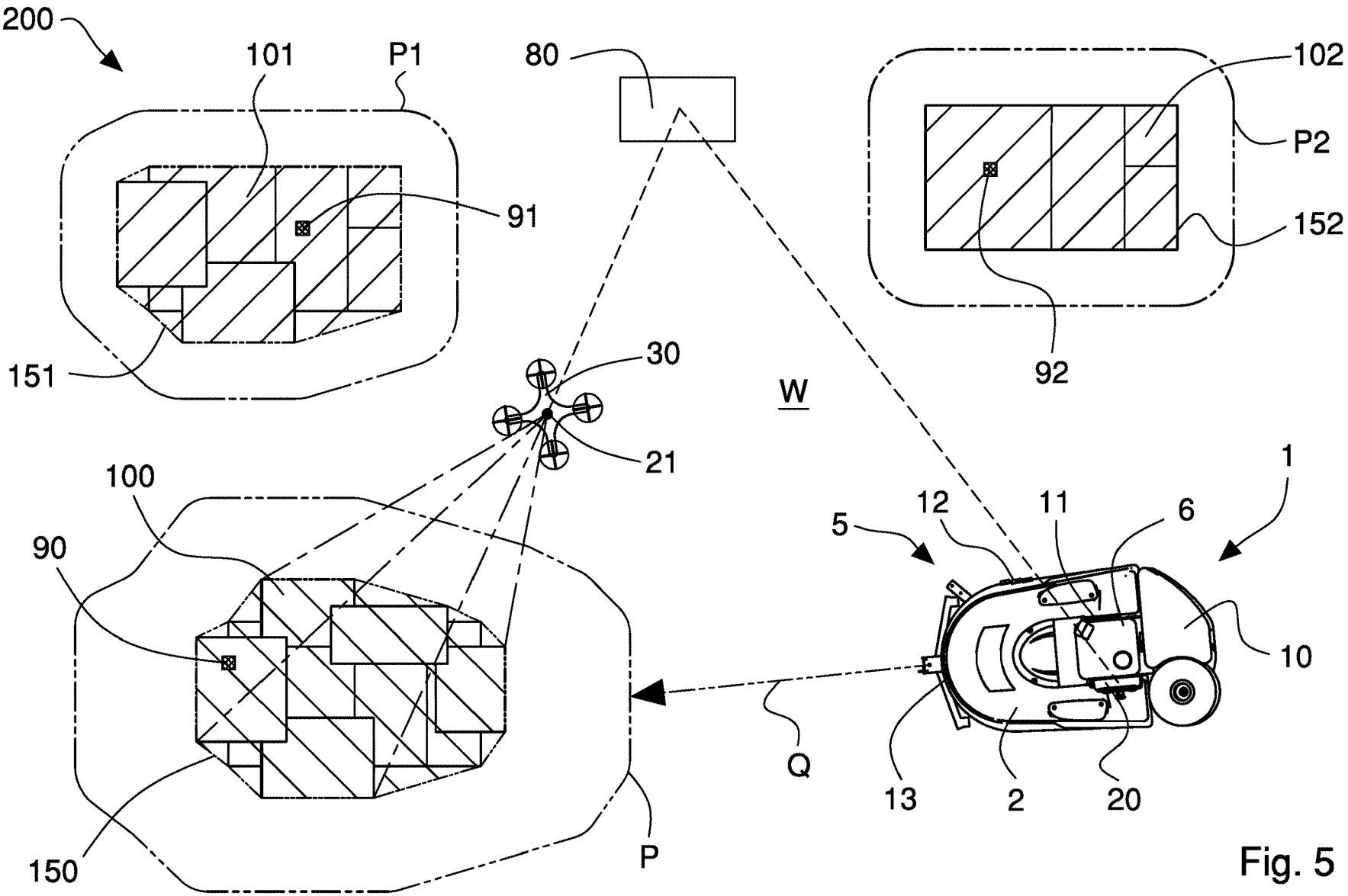
FIG. 5 is a plan view of a system of the invention for wrapping with a film made of plastic material a plurality of loads that are arranged in a working area and using a self-propelled wrapping machine.

With reference to FIG. 5, there is illustrated a wrapping system 200 according to the invention that is arranged for wrapping with a film made of plastic material, in particular of the cold-stretchable type, a plurality of loads 100, 101, 102 of different composition, form, and dimension that are present in a working area W.

The wrapping system 200 comprises at least a self-propelled wrapping machine 1 that is able to wrap a set load with a film made of plastic material, a drone 30 that is remotely controllable and provided with sensor means 21 for capturing images of surfaces and/or external edges of the different loads 100, 101, 102 that are present in the working area W, and a central processing unit 80 that is arranged for receiving signals and/or data related to scanned images from the sensor means 21 of the drone 30. In such a manner, the central processing unit 80 is able to detect and identify said loads 100, 101, 102, calculate, on the basis of the images of the surfaces and/or external edges, respective peripheral outlines 150, 151, 152 of plan maximum overall dimensions of said loads 100, 101, 102 and, on the basis of said peripheral outlines 150, 151, 15, process respective wrapping paths P, P1, P2 to be sent to the wrapping machine 1. The latter, moving around one of the loads 100, 101, 102 for wrapping the film 50 on a respective wrapping path P, P1, P2, is able to avoid collisions with said load.

The self-propelled wrapping machine 1 is provided with a self-propelled carriage 2 having a pair of driving wheels, at least one directional wheel and guide means 5 for directing the carriage 2, a substantially vertical column 6 that is fixed to the carriage 2 and slidably supports an unwinding unit 10 of the film and a control unit 20 for controlling at least the guide means 5 and guiding the wrapping machine 1.

The control unit 20 is provided with data transmission means, in particular in wireless mode, for receiving from the central processing unit 80 signals and data, in particular related to the wrapping path P, P1, P2 to be followed for the specific load 100, 101, 102 to be wrapped.

The drone 30 is a remote-controlled, and remotely controllable by an operator, small flying vehicle, which is provided with the sensor means comprising at least one imaging optical sensor 21 that is able to capture images of the surfaces and/or external edges of the loads 100, 101, 102. The imaging optical sensor 21 can comprise a camera or a video camera or a laser scanner sensor and is connected via transmission means of known type to the central processing unit 80 for transmitting to the latter data that are related to the captured images.

Thanks to the functional and operational features of the drone 30, the imaging optical sensor 21 is able to detect from the top the images of the different loads 100, by means of which the central processing unit 80, through the elaboration of the outlines and edges, can calculate the peripheral outlines 150, 151, 152 of maximum overall dimensions of the loads 100, 101, 102, and then the relative wrapping paths P, P1, P2.

The loads 100, 101, 102 can be provided with identification elements 90, 91, 92 (for example barcodes) that are arranged so as to be easily detectable and capturable by the sensor means 21 and decodable by the central processing unit 80 for enabling to identify each of the loads 100, 101, 102 in particular in order to obtain distinctive data such as dimensions, weight, type and composition of the products, destination, etc.

The drone 30 and the wrapping machine 1 are provided with respective position detecting or tracking devices for identifying respective positions in the space and sending related location data to the central processing unit 80. In such a manner, the central processing unit 80 is able to determine the position of the loads 100; 101; 102 in the working area W when overflown by the drone 30. The captured images of the loads can be in fact associated with the position in the space of the drone 30 at the time of the acquisition.

The central processing unit 80 is also able to know in real-time the position of the self-propelled wrapping machine 1 in the working area W and then calculate and send to the latter a respective approaching path Q to be followed for reaching the corresponding load 100 to be wrapped.

The control unit 20 of the self-propelled wrapping machine 1 is also able to use the respective position detecting device for accurately following the approaching path Q. The self-propelled wrapping machine 1 also comprises sensor means 11, 12, 13 that include a plurality of ultrasonic or ToF optical sensors that are arranged on the body 2 and on the column 6 and arranged for verifying that, during the approaching phase and the wrapping phase, the wrapping machine 1 does not get too close to, or even does not collide with, the load 100, for example in case the wrapping machine 1 does not exactly take place along the calculated approaching path Q and wrapping path P for unforeseen reasons. The sensor means 11, 12, 13, 21 also has the task of detecting, in addition to the surfaces and/or edges of the load 100, any obstacles that are arranged along the approaching path Q and the wrapping path P and sending a corresponding signal to the control unit 20 for stopping the operation and movement of the wrapping machine 1.

The operation of the wrapping system 200 of the invention and the related wrapping method provide in a first phase to capture images of surfaces and/or external edges of the loads 100; 101; 102 that are present in a working area W by means of the drone 30 that is remotely controllable and provided with sensor means 21.

By means of the central processing unit 80 that is arranged for receiving from the sensor means 21 of the 30 drone signals and/or data that are related to the captured images, is it possible to locate and identify the loads 100; 101; 102 in the working area W.

The identification of the loads can be facilitated by the presence of identification elements 90, 91, 92, for example barcodes on the load.

The central processing unit 80 also calculates, on the basis of the images that are related to surfaces and/or external edges of the loads 100, 101, 102, respective peripheral outlines 150, 151, 152 of the plan maximum overall dimensions of said loads and, on the basis of said peripheral outlines 150, 151, 152, processes corresponding wrapping paths P, P1, P2 around the loads 100, 101, 102 for the self-propelled wrapping machine 1 that is present in the working area W.

The central processing unit 80 then sends to the self-propelled wrapping machine 1, the wrapping path P, P1, P2 that is processed for the corresponding load 100, 101, 102 to be wrapped.

Thanks to the position detecting devices that are installed on the drone 30 and on the wrapping machine 1 the central processing unit 80 can determine a position of the loads 100, 101, 102 in the working area W and, when the position of the wrapping machine 1 is received, calculate and send to the latter a respective approaching path Q to be followed for reaching the set load 100 to be wrapped.

A variant of the wrapping system of the invention comprises a plurality of self-propelled wrapping machines 1 that are connected to the central processing unit 80 for receiving from the latter the respective wrapping paths P, P1, P2 to be followed so as to move around the respective loads 100, 101, 102, wrapping the latter with the film, avoiding collisions. Self-propelled wrapping machines 1 are provided with respective position detecting or tracking devices so as to send to the central processing unit 80 the corresponding positions in the working area W. Also in this case, the central processing unit 80 can calculate and send to the wrapping machines 1, which are desired to be used, respective approaching paths Q to be followed for reaching the corresponding loads 100 to be wrapped.

The wrapping system and method of the invention thus enable to wrap with plastic film, in particular of the cold-stretchable type, a plurality of loads that are present in a working area W, by using one or more self-propelled wrapping machines 1, in a substantially automated manner, minimizing the manual intervention by an operator.

By means of the drone 30 that overflies the working area W is in fact possible to capture with the sensor means 21, which is mounted on the drone 30, images that are related to surfaces and/or external edges of the loads 100, 101, 102 so as to enable the central processing unit 80 to locate and identify said loads in the working area W, and then calculate the peripheral outlines 150, 151, 152 of the plan maximum overall dimensions, on the basis of which to process the respective wrapping paths P, P1, P2 to be sent to the wrapping machine 1.

The central processing unit 80 is also able to know in real-time the position of the self-propelled wrapping machine(s) 1 in the working area W and then calculate and send to the latter the respective approaching paths Q to be followed for reaching a corresponding set load 100 to be wrapped.

The control unit 20 of the self-propelled wrapping machine 1 uses the respective position detecting device for accurately following the approaching path Q and, when gets close to the load, waits for the intervention of an operator who fix the initial film flap to the load itself. When the film is fixed to the latter, the wrapping machine 1 is activated to start the wrapping cycle during which it moves around the load along the calculated wrapping path P, maintaining in this manner at a correct minimum distance and avoiding collisions with protruding portions or products of the load itself.

The ultrasonic sensors 11, 12, 13 that are installed on the wrapping machine 1 also verify that during the wrapping phase the wrapping machine 1 does not get too close to, or even does not collide with, the load 100, departing from the wrapping path P for unforeseen reasons, and/or stop the wrapping machine detecting obstacles that are arranged along the wrapping path P.

It should be noted that during the whole identification, selection, load 100 wrapping process the manual intervention of the operator is limited to fix initial flap of the film to the load, the remaining phases and operational sequences being performed automatically by the central processing unit 80 in cooperation with the sensor means 21 of the drone 30 and the control unit 20 of the self-propelled wrapping machine 1. In this manner, it is possible to efficiently and productively manage and wrap a plurality of loads that are present in a working area, minimizing the duration of loads wrapping cycles, in particular reducing the time of pre-disposition and regulation of the wrapping machine at the respective loads to be wrapped.

The invention claimed is:

1. A self-propelled wrapping machine movable around a load for wrapping the load with a film made of plastic material, the self-propelled wrapping machine comprising:

a self-propelled carriage including:

traction wheels;

at least one directional wheel; and guide means for guiding said self-propelled carriage;

a column that is fixed to said self-propelled carriage and slidably supports an unwinding unit of the film;

sensor means for detecting at least one of surfaces or external edges of the load in total extension along a detection direction nearly orthogonal to a support plane of the load, and processing related signals; and a control unit for:

receiving from said sensor means the related signals;

calculating, based on the at least one of the surfaces or the external edges detected in total extension by said sensor means, a peripheral outline of plan maximum overall dimensions of the load;

processing, based on the peripheral outline, a wrapping path of said self-propelled wrapping machine around the load to avoid collisions of said self-propelled wrapping machine with the load, and controlling said guide means in order to guide said self-propelled wrapping machine along the wrapping path.

2. The self-propelled wrapping machine according to claim 1, wherein said guide means comprises one of:

first actuating means controlled by said control unit, said first actuating means configured to steer said at least one directional wheel; and driving means controlled by said control unit, said driving means configured to vary speeds of said traction wheels to steer said self-propelled wrapping machine.

3. A method for wrapping a load with a film made of plastic material by means of said self-propelled wrapping machine according to claim 2, the method comprising:

positioning said self-propelled wrapping machine at the load to be wrapped;

activating said sensor means of said self-propelled wrapping machine for detecting at least one of a surface or an external edge of the load closest to said self-propelled wrapping machine;

activating and moving said self-propelled wrapping machine around the load in a detecting phase for at least one starting round while maintaining a predefined distance between said self-propelled wrapping machine and the load;

during said moving in the at least one starting round, detecting and saving at least one of all of the surfaces or all of the external edges of the load in total extension;

calculating the peripheral outline of plan maximum overall dimensions of the load based on the at least one of all of the detected surfaces or all of the external edges of the load;

processing, based on the peripheral outline, a wrapping path of said self-propelled wrapping machine around the load so as to avoid collisions with the load; and moving in a wrapping phase said self-propelled wrapping machine along the wrapping path for a plurality of wrapping rounds to wrap the load with the film.

4. The self-propelled wrapping machine according to claim 1, wherein said sensor means comprises at least one imaging optical sensor configured to capture images of the at least one of the surfaces or the external edges in total extension.

5. The self-propelled wrapping machine according to claim 4, wherein said at least one imaging optical sensor is mounted on a drone that is remotely controllable and is connected to said control unit.

6. The self-propelled wrapping machine according to claim 1, wherein said sensor means comprises a plurality of sensors arranged on at least one of said self-propelled carriage and said column, said plurality of sensors being configured to measure a plurality of distances between said self-propelled wrapping machine and a plurality of points on the at least one of the surfaces or the external edges of the load, and said control unit is configured to recreate the surfaces and the external edges based on the measured plurality of distances and calculate the peripheral outline of plan maximum overall dimensions.

7. The self-propelled wrapping machine according to claim 1, wherein said control unit is configured to calculate, based on the at least one of the surfaces or the external edges, a maximum height of the load with respect to the support plane.

8. A method for wrapping a load with a film made of plastic material by means of said self-propelled wrapping machine according to claim 7, the method comprising:

positioning said self-propelled wrapping machine at the load to be wrapped;

activating said sensor means of said self-propelled wrapping machine for detecting at least one of a surface or an external edge of the load closest to said self-propelled wrapping machine;

activating and moving said self-propelled wrapping machine around the load in a detecting phase for at least one starting round while maintaining a predefined distance between said self-propelled wrapping machine and the load;

during said moving in the at least one starting round, detecting and saving at least one of all of the surfaces or all of the external edges of the load in total extension;

calculating the peripheral outline of plan maximum overall dimensions of the load based on the at least one of all of the detected surfaces or all of the external edges of the load;

processing, based on the peripheral outline, a wrapping path of said self-propelled wrapping machine around the load so as to avoid collisions with the load; and moving in a wrapping phase said self-propelled wrapping machine along the wrapping path for a plurality of wrapping rounds to wrap the load with the film.

9. The self-propelled wrapping machine according to claim 7, further comprising second actuating means for moving the unwinding unit along said column, wherein said control unit is configured to control said second actuating means to move the unwinding unit based on the maximum height.

10. A method for wrapping a load with a film made of plastic material by means of said self-propelled wrapping machine according to claim 9, the method comprising:

positioning said self-propelled wrapping machine at the load to be wrapped;

activating said sensor means of said self-propelled wrapping machine for detecting at least one of a surface or an external edge of the load closest to said self-propelled wrapping machine;

activating and moving said self-propelled wrapping machine around the load in a detecting phase for at least one starting round while maintaining a predefined distance between said self-propelled wrapping machine and the load;

during said moving in the at least one starting round, detecting and saving at least one of all of the surfaces or all of the external edges of the load in total extension;

calculating the peripheral outline of plan maximum overall dimensions of the load based on the at least one of all of the detected surfaces or all of the external edges of the load;

processing, based on the peripheral outline, a wrapping path of said self-propelled wrapping machine around the load so as to avoid collisions with the load; and moving in a wrapping phase said self-propelled wrapping machine along the wrapping path for a plurality of wrapping rounds to wrap the load with the film.

11. A method for wrapping a load with a film made of plastic material by means of said self-propelled wrapping machine according to claim 1, the method comprising:

positioning said self-propelled wrapping machine at the load to be wrapped;

activating said sensor means of said self-propelled wrapping machine for detecting at least one of a surface or an external edge of the load closest to said self-propelled wrapping machine;

activating and moving said self-propelled wrapping machine around the load in a detecting phase for at least one starting round while maintaining a predefined distance between said self-propelled wrapping machine and the load;

during said moving in the at least one starting round, detecting and saving at least one of all of the surfaces or all of the external edges of the load in total extension;

calculating the peripheral outline of plan maximum overall dimensions of the load based on the at least one of all of the detected surfaces or all of the external edges of the load;

processing, based on the peripheral outline, a wrapping path of said self-propelled wrapping machine around the load so as to avoid collisions with the load; and moving in a wrapping phase said self-propelled wrapping machine along the wrapping path for a plurality of wrapping rounds to wrap the load with the film.

12. The method according to claim 11, further comprising, before said activating of said self-propelled wrapping machine, fixing an initial flap of the film to the load so as to wrap the load with the film during the detecting phase.

13. The method according to claim 11, wherein said moving of said self-propelled wrapping machine in the detecting phase occurs with a speed that is lower than an operating speed of said moving of said self-propelled wrapping machine during the wrapping phase.

14. The method according to claim 11, further comprising, before said moving of said self-propelled wrapping machine in the wrapping phase, fixing an initial flap of the film to the load.

15. The method according to claim 11, further comprising calculating a maximum height of the load with respect to the support plane based on the at least one of all of the detected surfaces or all of the external edges of the load.

16. The method according to claim 15, wherein said moving of said self-propelled wrapping machine in the detecting phase occurs with a speed that is lower than an operating speed of said moving of said self-propelled wrapping machine during the wrapping phase.

17. A self-propelled wrapping machine movable around a load to wrap the load with a film made of plastic material, self-propelled wrapping machine comprising:

a self-propelled carriage including:

traction wheels;

at least one directional wheel; and guide means for directing said self-propelled carriage;

a column that is fixed to said self-propelled carriage and slidably supports an unwinding unit of the film;

sensor means for detecting, during rotation of said self-propelled wrapping machine about the load, at least one of surfaces or external edges of the load in total extension along a detection direction nearly orthogonal to a support plane of the load, and process related signals; and a control unit for receiving from said sensor means the related signals and controlling said guide means in order to guide said self-propelled wrapping machine around the load in order to avoid collisions with the at least one of the surfaces or the external edges that are detected by said sensor means.

18. The self-propelled wrapping machine according to claim 17, wherein said sensor means comprises a plurality of sensors arranged on at least one of said self-propelled carriage and said column, said plurality of sensors being configured to measure a plurality of distances between said self-propelled wrapping machine and a plurality of points on the at least one of the surfaces or the external edges of the load, and said control unit is configured to recreate the surfaces and the external edges based on the measured plurality of distances, and then control said guide means in order to guide said self-propelled wrapping machine around the load so as to avoid collisions with the at least one of the surfaces or the external edges of the load.

19. The self-propelled wrapping machine according to claim 17, wherein said control unit is configured to calculate, based on the at least one of the surfaces or the external edges of the load, a maximum height of the load with respect to the support plane.

20. The self-propelled wrapping machine according to claim 19, further comprising second actuating means for moving the unwinding unit along said column, wherein said control unit is configured to control said second actuating means to move the unwinding unit based on the maximum height.

* * * * *